US006450849B1

(12) United States Patent
Harada

(10) Patent No.: US 6,450,849 B1
(45) **Date of Patent: *Sep. 17, 2002**

(54) METHOD OF MANUFACTURING GAS DISCHARGE DISPLAY DEVICES USING PLASMA ENHANCED VAPOR DEPOSITION

(75) Inventor: Hideki Harada, Akashi (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/289,579

(22) Filed: Apr. 12, 1999

(30) Foreign Application Priority Data

Jul. 7, 1998 (JP) ..... 10-191273

(51) Int. Cl.[7] ..... H01J 9/02
(52) U.S. Cl. ..... 445/24
(58) Field of Search ..... 445/24, 70; 313/581, 313/586

(56) References Cited

U.S. PATENT DOCUMENTS 5,684,356 A * 11/1997 Jeng et al. ..... 445/70
5,727,977 A * 3/1998 Maracas et al. ..... 445/24
5,770,921 A * 6/1998 Aoki et al. ..... 313/581
5,852,481 A * 12/1998 Hwang ..... 349/43
5,874,326 A * 2/1999 Lyu ..... 438/158
5,907,215 A * 5/1999 Mougin et al. ..... 445/70

FOREIGN PATENT DOCUMENTS

JP SHO 53-74882 7/1978
JP SHO 53-125760 11/1978
JP SHO 56-109432 8/1981

* cited by examiner

*Primary Examiner*—Kenneth J. Ramsey
(74) *Attorney, Agent, or Firm*—Staas & Halsey LLP

(57) ABSTRACT

A fabricating method of a gas discharge display device having a dielectric layer spreading over an entire display area so as to cover electrodes arranged on a substrate, comprising arranging the electrodes on the substrate; and forming conformally the dielectric layer upon a surface of the substrate, on which the electrodes have been arranged, by the use of a plasma vapor deposition method. The fabricating method may further comprise forming a light shielding layer between the electrodes excluding at least the surface discharge gap within the display area before forming the dielectric layer.

13 Claims, 7 Drawing Sheets

PRIOR ART

METHOD OF MANUFACTURING GAS DISCHARGE DISPLAY DEVICES USING PLASMA ENHANCED VAPOR DEPOSITION

BACKGROUND OF THE INVENTION

1. Field of the Invention

This invention relates to a manufacturing method of a gas discharge display device having an electrode group and a dielectric layer covering same, which is used for generating a discharge in a plasma display panel (PDP) and a plasma addressed liquid crystal (PALC), etc.

PDPs have become popular as a large display device of television picture and computer output upon the achievement of the colored PDP.

2. Description of the Related Arts

As colored displays there have been commercially in production AC type PDPs of a three-electrode surface discharge structure, which are provided with a pair of main electrodes, i.e., a first electrode and a second electrode, for sustaining lighting for the display of each line, and an address electrode, i.e., a third electrode, for each row. In the displaying operation, the AC type PDPs utilize a memory function of the dielectric layer which covers the main electrodes. That is, an addressing is performed in a line scan mode so as to form a charged state in accordance with the contents to be displayed; next, a light sustain voltage Vs having alternating voltage polarities is applied concurrently to all the main electrode pairs. Then, surface discharges are generated along the substrate surface only in the cells having wall charges therein owing to an effective voltage, i.e., a cell voltage, exceeding the discharge firing voltage Vf. Short intervals of the sustain voltages provide a visually continuous lighting state.

In the surface discharge type PDPs, long life can be expected by reducing the deterioration of the fluorescent material layer for the color display caused from ion bombardment during the discharge, by placing the fluorescent material layer on a back substrate opposite from the front substrate carrying the main electrode pairs. The fluorescent material layer coated on the back substrate is called a reflection type, while the fluorescent material layer coated on the front substrate is called a transparent type. The luminous efficiency is advantageous in the reflection type where the front surface of the fluorescent material layer emits the light.

The dielectric layers are used not only for a simple insulating layer in an LCD device, but also for storing electric charges for the AC drive as described above, and have been fabricated by a thick film method where a low-melting temperature glass paste is printed flat and is sintered. The dielectric constant and the thickness of the dielectric layer determined the firing voltage and the discharging current such that a thicker and lower dielectric constant provides less capacitance allowing less (i.e., a reduced) discharging current. Accordingly, the dielectric layer is required to be thicker than a predetermined thickness. However, too thick a dielectric layer requires too high a firing voltage.

There has also been a problem in that the dielectric layer of the prior art thick film method generates bubbles during the firing process resulting in a difficulty in fabricating a uniform film entirely over the screen. The generated bubbles deteriorate the withstanding voltage between the main electrode and the address electrode. Moreover, in the reflection type PDP where the dielectric layer is located on the front substrate, the transparency is deteriorated by the bubbles resulting in less (i.e., reduced) brightness through the front substrate.

Moreover, there are problems in that the high dielectric constant of the low melting point glass requires more electric power in charging the electrostatic capacitance between the electrodes; and causes thermal stress during the firing process as well. Reduced thickness of the dielectric layer may decrease the electrostatic capacitance between the electrodes; however, in coating the glass paste film the thinner layer is apt to cause undulation resulting in an increase in variation of the discharge characteristic, and may increase a fear of exposing the electrode.

Furthermore, the upper surface of dielectric layer 17*p* formed by a screen printing method or a spin coating method is almost flat regardless of rises and falls of the upper surface of the electrodes 41*p* & 42*p* on the substrate 11*p* as shown in FIG. 8 schematically illustrating a cross-sectional cut view of main portion of a prior art PDP. Accordingly, in the reflection type the thickness of the dielectric layer on the metal film 42*p* is thinner than that of the dielectric layer on the transparent electrode 41*p*, whereby a strong discharge is generated above the metal film 42*p* even though distant from the surface discharge gap. This discharge consumes the power with little contribution to the display light because the light of the discharge is shielded by metal film 42*p*.

In order to solve those problems some thin film methods have attempted to form the dielectric layer. However, evaporation methods and a CVD (chemical vapor deposition) method at normal pressure have failed to form the film of adequate thickness without cracks.

SUMMARY OF THE INVENTION

It is a general object of the invention to provide a method to form a homogenous dielectric layer having a small dielectric constant, and an adequate thickness, leaving a proper thermal stress on the glass substrate, so as to be used in a gas discharge display device.

After main electrodes for generating a surface discharge therebetween are fabricated on a substrate, a dielectric layer is deposited on the substrate as well as on the electrodes by a plasma chemical deposition method. The material of the dielectric layer is typically silicon dioxide. Thickness of the dielectric layer is 5 to 30 $\mu$m thick.

The above-mentioned features and advantages of the present invention, together with other objects and advantages which will become apparent, will be more fully described hereinafter, with references being made to the accompanying drawings which form a part hereof, wherein like numerals refer to like parts throughout.

DETAILED DESCRIPTION

First of all, the general concept to reach the present invention is hereinafter described.

(1) The Properties, i.e., the Thickness and the Dielectric Constant, of the Insulating Film Upon the Electrode. If the thickness of the insulating film upon the electrode is thinner than a required value and/or the dielectric constant of the insulating film is high, the discharge current, i.e., the lighting, generated thereupon by the use of electric charges accumulated thereon becomes so strong that the luminous efficiency is deteriorated. In other words, less discharge current provides more luminous efficiency. This fact has been widely known. On the other hand, too large a thickness and/or too small a dielectric constant of the insulating film require too high a discharge firing voltage.

(2) Thermal Stress Remaining on the Insulating Film. The thermal expansion coefficient of the insulating film is smaller than that of the glass substrate deposited with the insulating film thereon. Accordingly, the glass substrate is warped when cooled after the deposition process. The amount of the warp has to be within a limit so that no cracks are generated in the insulating film and so that two glass substrates can be sealed together, and the warped substrates convex toward the opposite substrate.

The present invention is to provide a method and an insulating layer material to satisfy these requirements.

Figure 1:
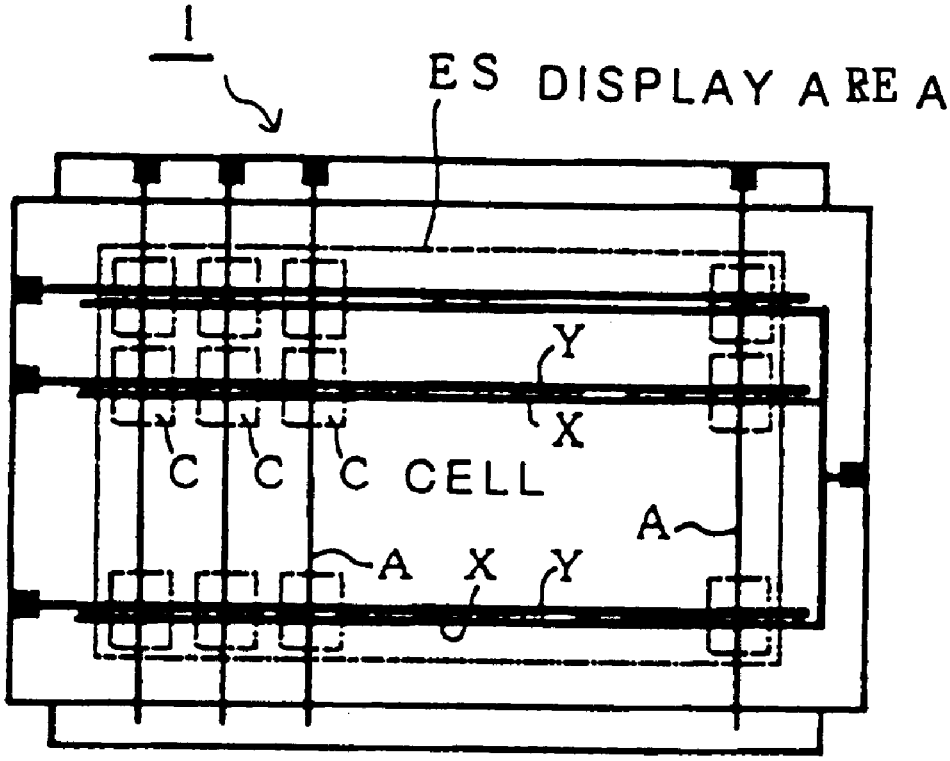
FIG. 1 schematically illustrates an electrode arrangement of a PDP related to the present invention.

Detail of the present invention is hereinafter described representatively referring to plasma display panels. FIG. 1 schematically illustrates an electrode arrangement of a PDP 1 in which the present invention is embodied.

PDP 1 is an AC type PDP of a three electrode surface discharge type where there are arranged first main electrodes X and second main electrodes Y in pair in parallel, and address electrodes as third electrodes A to cross the main electrodes X & Y at each cell C. Main electrodes X & Y both extend along the line direction, i.e., the horizontal direction in FIG. 1, where the second main electrode Y is utilized as a scan electrode for selecting the cells line by line during an address period. Address electrodes A extend along the row direction, i.e., the vertical direction in FIG. 1, and are utilized to select the cells row by row. An area in which the main electrodes and address electrodes cross each other is referred to as a display area, i.e., a screen, ES.

Figures 2A, 2B:
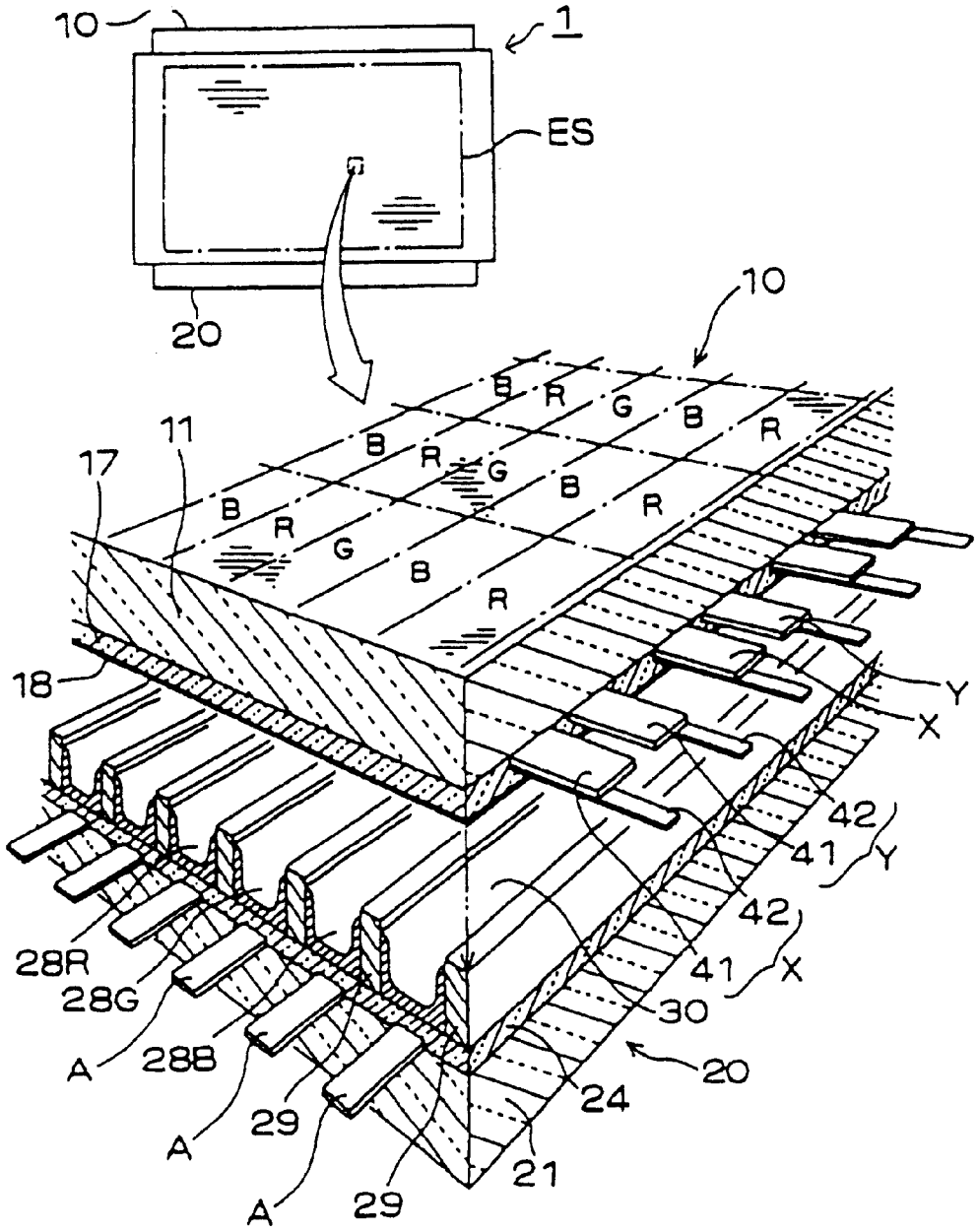
FIGS. 2A and 2B illustrate a decomposition perspective view of basic structure inside the PDP related to the present invention.

FIGS. 2A and 2B schematically illustrate a decomposition perspective view of basic structure inside the PDP related to the present invention. PDP 1 is of a reflection type, and is formed of a pair of substrate structures 10 & 20. A pair of first and second main electrodes X & Y are arranged for each line upon an inner surface of glass substrate 11, which is a raw material of the substrate structure 10 of the front side. The line is formed of the cells aligned along the horizontal direction. First and second main electrodes X & Y are respectively formed of a stack of a typically 0.02 $\mu$m thick transparent conductive film 41 and a typically 3 $\mu$m thick metal film 42, which may be called a bus conductor, and are covered with a typically 10 $\mu$m thick dielectric layer 17. Upon the surface of dielectric layer 17 is provided a typically several angstrom thick protection layer 18 formed of magnesium oxide (MgO).

Address electrodes A are arranged upon an inner surface of glass substrate 21, which is a raw material of the substrate structure 20 of the back side; and the address electrodes A are covered with a dielectric layer 24. Upon dielectric layer 24 is provided a typically 150 $\mu$m high separator wall in a shape of stripe in a plain view between adjacent address electrodes. Separator walls divide a discharge space 30 into sub-pixels, i.e., unit luminous area, along the line direction, as well as define the gap, i.e., the height, of the discharge space.

Three fluorescent material layers 28R, 28G & 28B respectively of red, green & blue for the color display are provided so as to cover the inner surface of the back substrate, including above the address electrodes and the sides of the separator walls. The discharge space 30 is filled with a discharge gas, that is typically a mixture of xenon gas into neon gas which is the majority so that an ultraviolet light emitted in the discharge locally excites the respective fluorescent material layer to emit a light of the respective color. Thus, a single pixel, i.e., a picture element, of the display, is formed with three sub-pixels respectively of the three colors aligning along the line direction. The structure in each sub-pixel is a cell, i.e., a display element C. A space which corresponds to each row within the discharge space 30 is continuous along the row direction so as to cross over all the lines L.

Figure 3:
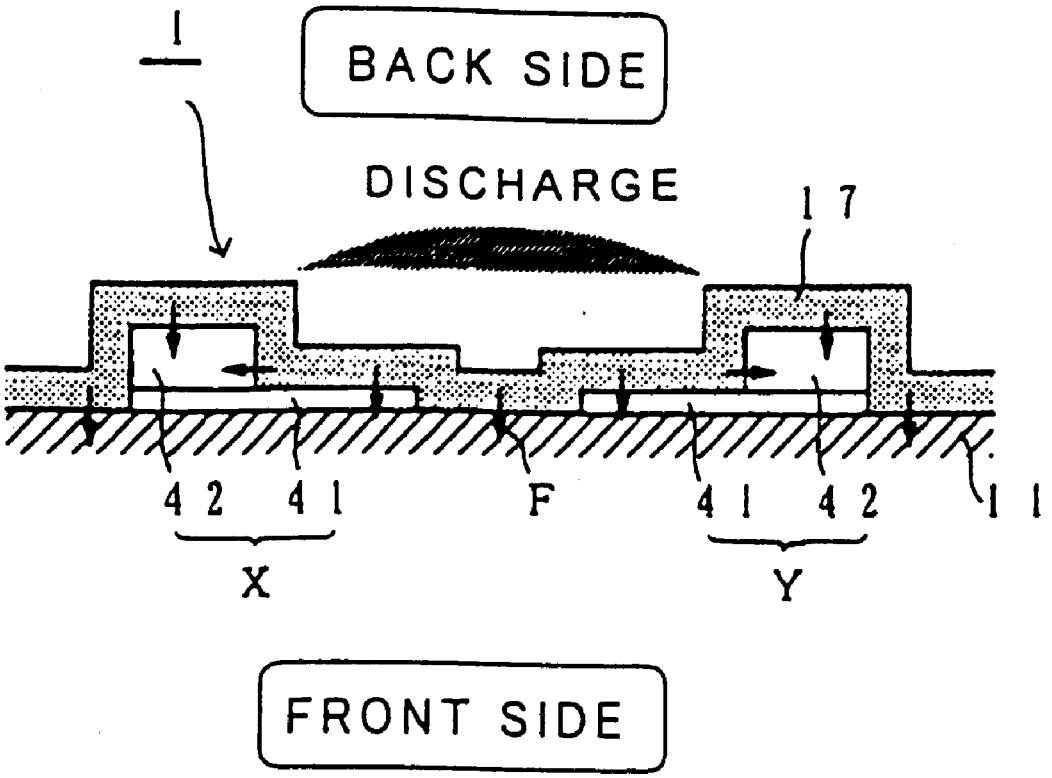
FIG. 3 schematically illustrates a cross-sectional cut view of main portions of the PDP related to the present embodiment.

FIG. 3 schematically illustrates a cross-sectional cut view of the main portion of a PDP of the present invention as a first preferred embodiment of the present invention. For an easy comprehension the dielectric layer structure 17 of the front side of PDP 1 is drawn on the lower side in the figure, and the protection layer is omitted therefrom. The same technique is employed in illustrating the main portion of the PDPs in the following preferred embodiments.

The PDP 1 is completed by sealing the front and back substrates together, each fabricated with the structural elements, and exhausted and filled with the discharge gas therein. A method according to the present invention to fabricate the dielectric layer 17 is carried out by the use of a plasma-enhanced CVD method, which is a kind of thin film formation method, referred to hereinafter simply as a plasma CVD.

Figures 4A, 4B:
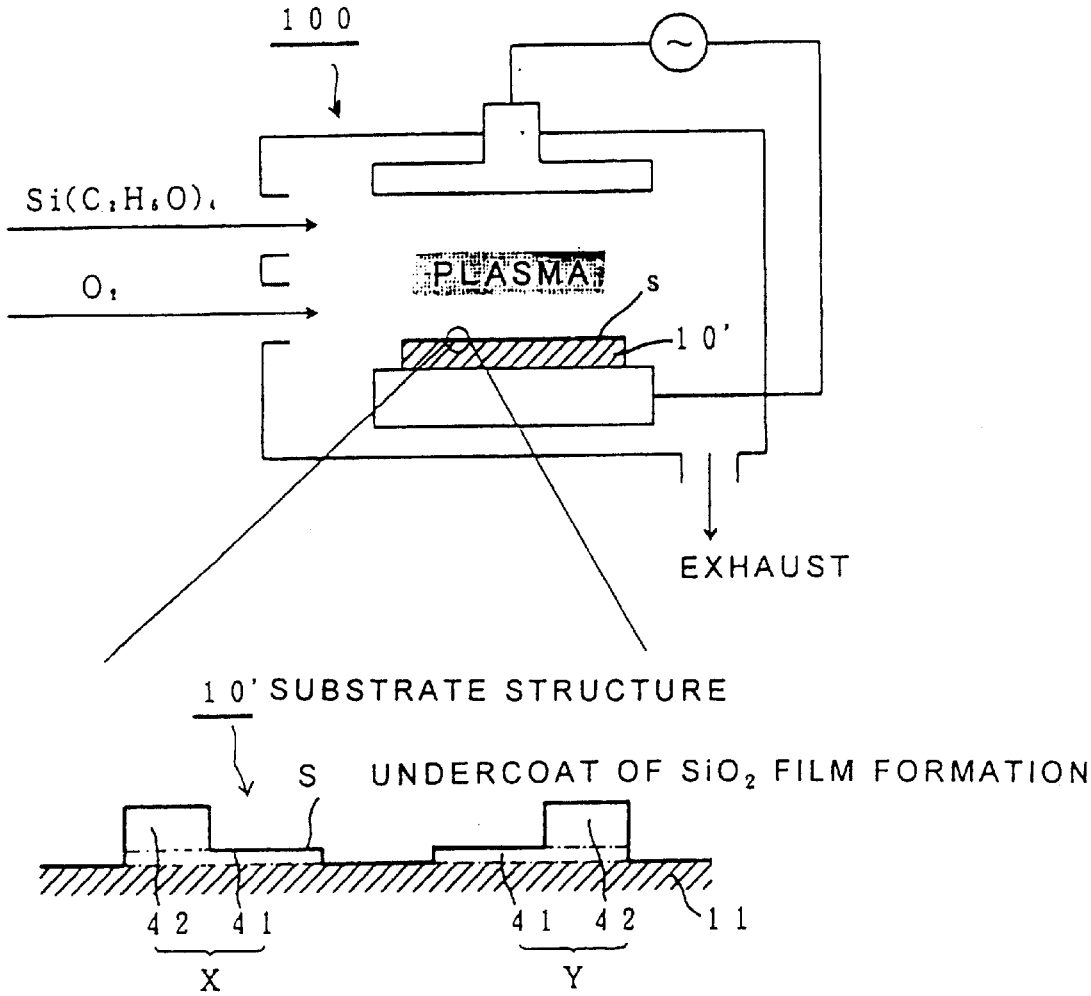
FIGS. 4A and 4B schematically illustrate a plasma CVD apparatus related to the present invention.

Referring to FIG. 3 and FIGS. 4A and 4B, a first preferred embodiment of the present invention is hereinafter described. Upon a substrate provided with transparent electrically conductive film 41 and metal film 42, an $SiO_2$ (silicon oxide) film is formed as thick as 10 $\mu$m by the use of a plasma CVD apparatus 100.

A typical plasma CVD apparatus 100 used in the present invention is of a parallel plane electrode type, and is schematically illustrated in FIGS. 4A and 4B. A substrate structure 10' on which the main X & Y electrodes have been arranged is placed in a vacuum chamber where plasma is generated from a source gas added with a reaction gas filled therein while applying a high frequency voltage between two electrodes so that a $SiO_2$ film 17 is deposited according to the below-described condition on a soda lime glass substrate structure 10' having the electrodes thereon. The material and the dimension of the glass substrate structure are shown in TABLE 1.

TABLE 1

Glass Substrate Material: Soda Lime Glass
Sizes: 980×600×3 mm
Thermal Expansion Coefficient: 9 ppm
Main Electrodes:
Transparent Electrodes:
Material: ITO (indium tin oxide)
Thickness: 0.02 $\mu$m
Metal Film: Material Cr/Cu/Cr
Thickness: 0.1/2.0/0.1 $\mu$m

| | |
|---|---|
| Source Gas and its Flow Rate | TEOS/800 SCCM |
| Reaction Gas and its Flow Rate | $O_2$/2000 SCCM |
| Radio Frequency Power | 1.5 kW |
| Substrate Temperature | 350° C. |
| Vacuum | 1.0 Torr |

where TEOS indicates tetra ethoxy silane, $Si(C_2H_5O)_4$. 10 minutes of this process yielded about 10 $\mu$m thick $SiO_2$ film (i.e., in conformance with) on the substrate as well as on each electrode.

The same deposition process was performed upon a sample silicon substrate with the same conditions, in order to acquire comparison data.

It was found that thus formed $SiO_2$ films have a compression stress, $-1.9\times10^9$ dyn/cm$^2$ and $-0.7\times10^9$ dyn/cm$^2$ respectively for the soda lime glass and the silicon substrate.

On completion of the $SiO_2$, film, the substrate structure was in a warp to swell the deposited surface up as high as approximately 5 mm. This is because the thermal expansion coefficient of the $SiO_2$ film is larger than that of the soda lime glass substrate, and accordingly the substrate tends to shrink more than the $SiO_2$ film when cooled after the deposition process. The thermal expansion coefficient of the deposited $SiO_2$ was calculated from the amount of the deformation and from the data acquired from the sample Si substrate.

Next, upon thus formed $SiO_2$ film was deposited a typically 0.5 $\mu$m thick MgO film. Then, the processed glass substrate is sealed with a back glass substrate separately prepared with a low melting point glass paste.

The above mentioned warp, if within an appropriate amount, is preferrably located at the center towards the inner side of the PDP for keeping an equal gap between the two substrates after having been sealed together.

Luminous efficiency of the fabricated PDP was measured to be 1.5 Im/w.

A second preferred embodiment employs other gases and conditions than those of the first preferred embodiment while employing the same plasma CVD apparatus so as to deposit $SiO_2$ on a soda lime glass substrate shown in TABLE 1 and on a sample silicon wafer.

| | |
|---|---|
| Source Gas and its Flow Rate | $SiH_4$/900 SCCM |
| Reaction Gas and its Flow Rate | $N_2O$/4000 SCCM |
| Radio Frequency Power | 1.0 kW |
| Substrate Temperature | 340° C. |
| Vacuum | 1.2 Torr |

The deposited approximately 10 $\mu$m thick $SiO_2$ films during 8 minutes of the process having a compression, $-0.2\times10^9$ dyn/cm$^2$ and an $-0.7\times10^9$ dyn/cm$^2$ for the soda lime glass and the silicon substrate, respectively.

After an upper surface of the glass substrate was deposited with $SiO_2$films, the glass substrate was in a warp to swell upward by approximately 1 mm at the central portion. The subsequent MgO deposition and the sealing process are the same as those of the first preferred embodiment. Luminous efficiency of the finished PDP was 1.5 Im/w.

A third preferred embodiment employs other gases and conditions shown below than those of the above first and second preferred embodiments while employing the same plasma CVD apparatus to deposit an organic silicon oxide ($CH_3SiO$) film on the soda lime glass substrate of TABLE 1.

| | |
|---|---|
| Source Gas and its Flow Rate | $Si(CH_3)_4$/800 SCCM |
| Reaction Gas and its Flow Rate | $H_2O$/4000 SCCM |
| Radio Frequency Power | 2.0 kW |
| Substrate Temperature | 400° C. |
| Vacuum | 1.0 Torr |

The produced $CH_3SiO$ film after 15 minutes of the process was approximately 10 $\mu$m thick, had a compression of $-0.2\times10^9$dyn/cm$^2$ on the soda lime glass and had a specific dielectric constant of 2.6. The warp swelling upward at the central portion was approximately 1 mm.

The substrate structure formed with the produced $CH_3SiO$ film was coated with a 0.5 $\mu$m thick MgO film and was sealed with a back substrate by the same technique as those of the above preferred embodiments so as to complete a PDP, where the luminous efficiency was measured to be 1.7 Im/w.

A fourth preferred embodiment employed gases and conditions shown below other than those of the above-described preferred embodiments while employing the same plasma CVD apparatus to deposit a silicone nitride (SiN) film on the same soda lime glass substrate of TABLE 1 and a sample silicon substrate.

| | |
|---|---|
| Source Gas and its Flow Rate | $SiH_4$/1000 SCCM |
| Reaction Gas and its Flow Rate | $N_2$/3200 SCCM |
| | $NH_3$/8000 SCCM |
| Radio Frequency Power | 1.0 kW |
| Substrate Temperature | 400° C. |
| Vacuum | 2.6 Torr |

The SiN film produced after 20 minutes of the process was approximately 10 $\mu$m thick, had a compression of $-0.8\times10^9$dyn/cm$^2$ on the Si substrate, and a specific dielectric constant of 7.0. The deposited soda lime glass was processed so as to be sealed with the back substrate by the same technique as the above-preferred embodiments to complete a PDP. The luminous efficiency of the completed PDP was measured to be 1.1 Im/w.

A fifth preferred embodiment employed gases and conditions shown below other than those of the above first to third preferred embodiments so as to deposit a $SiO_2$ film on the soda lime glass substrate of the material shown in TABLE 1, but of the dimension 320×200×2 mm thick. The warp was 4 mm to successfully allow the sealing with the back substrate.

| | |
|---|---|
| Source Gas and its Flow Rate | $SiH_4$,/900 SCCM |
| Reaction Gas and its Flow Rate | $N_2O$/10,000 SCCM |
| Radio Frequency Power | 2.0 kW |

-continued

| | |
|---|---|
| Substrate Temperature | 340° C. |
| Vacuum | 1.2 Torr |

In order to acquire first reference data, $SiO_2$ films, i.e., hot CVD films, were formed respectively on a silicon substrate and on a soda lime glass in both the first preferred embodiment and TABLE 1 by the below described conditions employing the CVD apparatus 100.

| | |
|---|---|
| Source Gas and its Flow Rate | $SiH_4$/900 SCCM |
| Reaction Gas and its Flow Rate | $N_2O$/6000 SCCM |
| Radio Frequency Power | 0 kW |
| Substrate Temperature | 450° C. |
| Vacuum | atmospheric pressure |

The produced $SiO_2$ film after 100 minutes of the process was approximately 10 $\mu$m thick, had a tension of $+2.3\times10^9$ dyn/cm$^2$ on the soda lime glass and a compression of $+4.0\times10^9$ dyn/cm$^2$ on the silicon substrate and a specific dielectric constant of 2.3. However, there were many cracks generated on the film; accordingly, it was impossible to seal the two substrates to complete a PDP.

In order to acquire second reference data, approximately 10 $\mu$m thick $SiO_2$ films were formed respectively on a silicon substrate and on a soda lime glass in both the first preferred embodiment and TABLE 1 by the below-described conditions employing the same CVD apparatus 100 as the first preferred embodiment.

| | |
|---|---|
| Source Gas and its Flow Rate | $SiH_4$/900 SCCM |
| Reaction Gas and its Flow Rate | $N_2O$/5000 SCCM |
| Radio Frequency Power | 1.8 kW |
| Substrate Temperature | 380° C. |
| Vacuum | 0.7 Torr |

The produced approximately 10 $\mu$m thick $SiO_2$ film after 9 minutes of the process had a compression of $-4.6\times10^9$ dyn/cm$^2$ on the soda lime glass and a tension of $+4.0\times10^9$ dyn/cm$^2$ on the silicon substrate. However, the warp to swell toward the upper side was as high as approximately 12 mm, which was too much to allow the substrate to be sealed with the back substrate.

Figure 8:
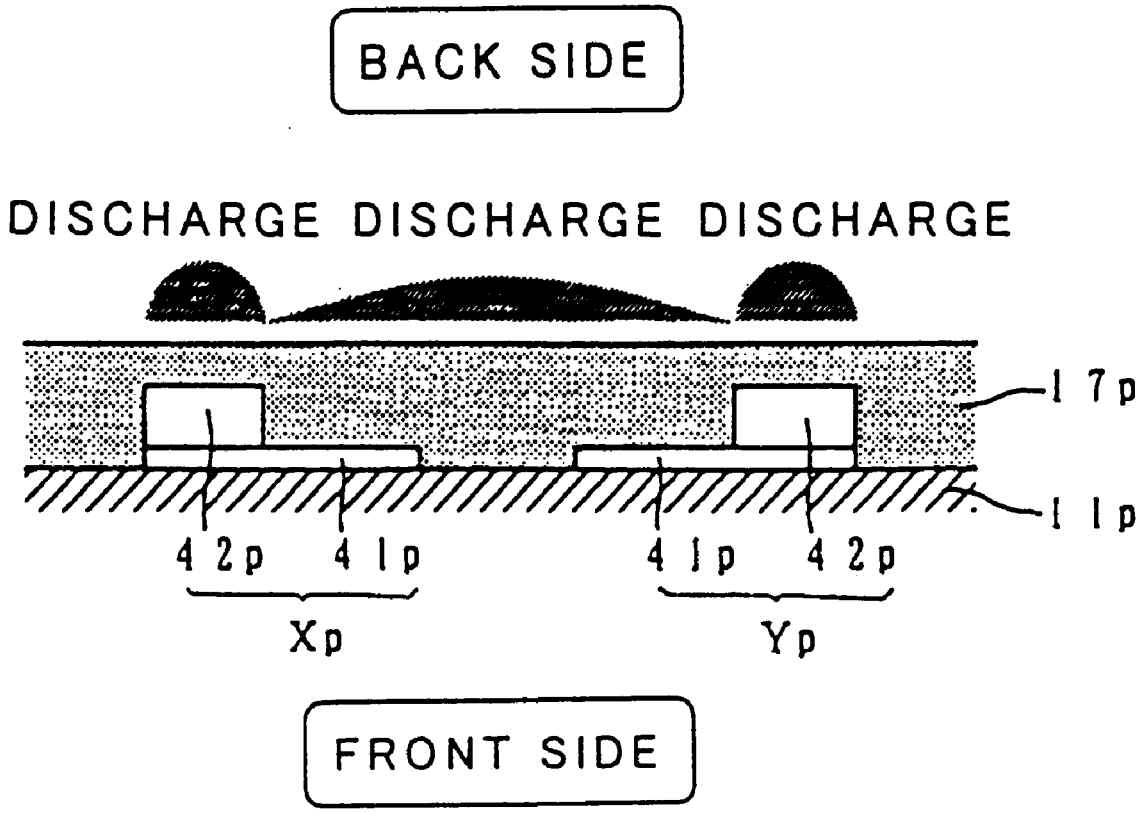
FIG. 8 schematically illustrates a cross-sectional cut view of main portions of a prior PDP.

As shown in FIG. 3, metal film 42 has been placed at transparent electrically conductive electrode 41's side opposite from the surface discharge gap. Accordingly, the advantageous effect of the above-described preferred embodiments are particular in that dielectric layer 17 is of a low dielectric constant, and homogeneously and conformingly covers the first and second main electrodes X & Y. Moreover, the advantage is in that the SiO film generates a compression stress indicated with arrows in the figure, and includes no bubble. The conforming thickness of the dielectric layer above the electrodes allows its surface to follow the heights of the underlying electrodes as shown in the figure. Accordingly, the undesirable discharge described above with FIG. 8 is difficult to effectuate through the locally thin dielectric layer above the metal electrode 42, whereby it is easy to provide an appropriate discharge range by selecting the driving voltages. In order to acquire a third set of reference data employing a prior art thick film method to form the dielectric layer, flit glass of a low-melting temperature containing PbO—BO—SiO was printed as thick as approximately 30 $\mu$m by the use of a screen printer on the same glass substrate and on the same substrate structure as the first preferred embodiment shown in TABLE 1. The substrate and the substrate structure were fired at 580° C. in an air atmosphere in a continuous furnace for 60 minutes. The produced glass layer included very many air bubbles. The specific dielectric constant was measured to be 12.0. The fabricated substrate structure was coated with a 0.5 $\mu$m thick MgO and sealed with the back substrate structure so as to complete a PDP in the same way as the above preferred embodiments. The luminous efficiency was measured to be 0.8 Im/w.

Figure 5:
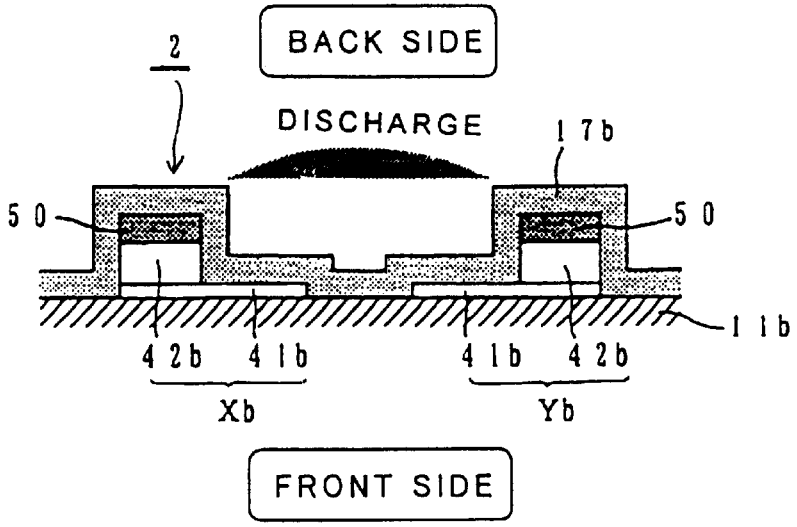
FIG. 5 schematically illustrates a cross-sectional cut view of main portions of the PDP related to the sixth preferred embodiment.

An electrode structure of a sixth preferred embodiment of the present invention is hereinafter schematically illustrated with reference to a second PDP 2 shown in FIG. 5. After the first and second main electrodes are formed with the transparent conductive electrode 42*a* stacked with a metal film 42*b* thereon, but before forming the first dielectric layer 17*b* by the thin film method, upon a top of metal layer 42*b* of each main electrode Xb & Yb is arranged a second dielectric layer 50 typically formed of a low-melting point glass and of typically 10 $\mu$m thickness by a method of silk screen printing and is fired to melt, and then first dielectric layer 17*b* is formed upon all over the surface of the glass substrate including the electrodes 41*b* & 42*b* and second dielectric layer 50. The added second dielectric layer 50 on the metal electrode 42*b* makes the thickness of the dielectric layers on the metal electrode 42*b* greater than the other part of the main electrodes Xb & Yb so as to reduce the capacitance between the upper surface of the first dielectric layer 17*b* and the metal electrode 42*b*; accordingly it reduces the wall charges to be generated above the metal electrode so that the unnecessary surface discharge generated above the metal electrode is suppressed. It has been well known that in a glow discharge the brightness and luminous efficiency are not compatible with each other, as the reduction of the unnecessary surface discharge less concentrated above the metal electrode increases the luminous efficiency of the PDP.

Figure 6:
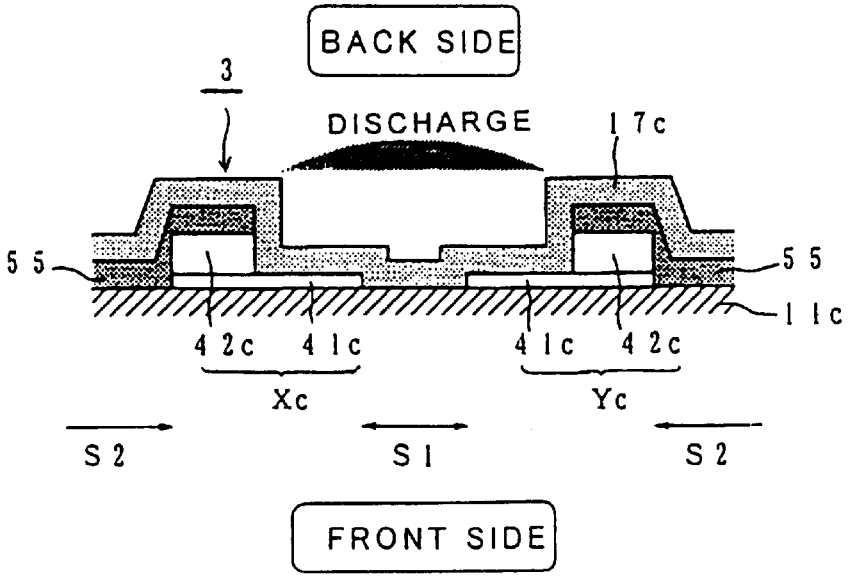
FIG. 6 schematically illustrates a cross-sectional cut view of main portions of the PDP related to the seventh preferred embodiment.
Figures 7A, 7B:
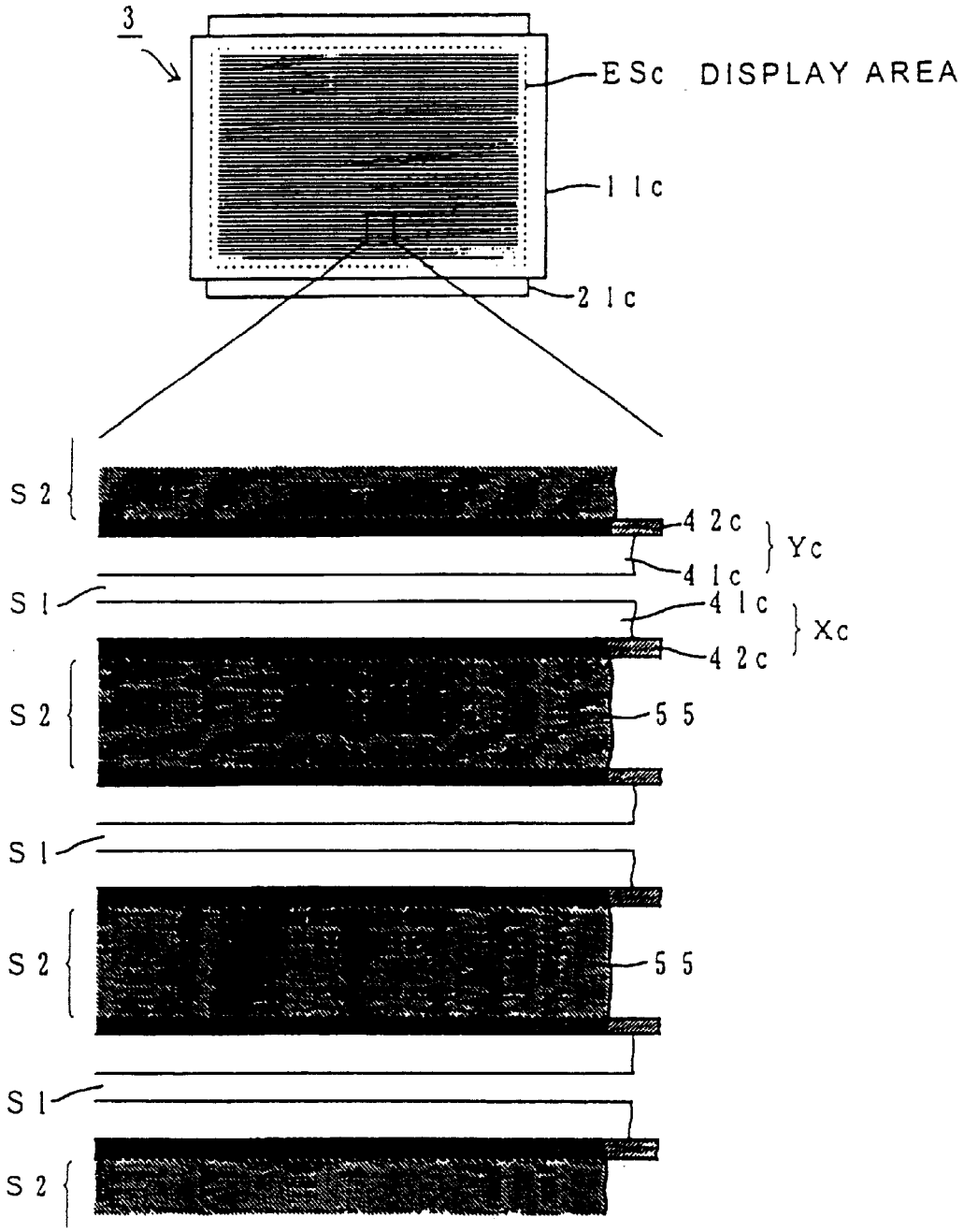
FIGS. 7A and 7B schematically illustrate a display area of a PDP related to the seventh preferred embodiment.

An electrode structure of a seventh preferred embodiment of the present invention is hereinafter schematically illustrated with reference to a third PDP 3 shown in FIG. 6. In fabricating the third PDP 3, after forming main electrodes Xc & Yc by sequentially depositing transparent electrode 41*c* and metal film 42*c* on front glass substrate 11*c* and before forming dielectric layer 17*c* with the thin film according to the above-described preferred embodiments, a third dielectric layer 55, typically formed of glass including chrome oxide, iron oxide and manganese oxide, or of a dark color such as black, is arranged so as to cover metal electrode 42*c* and a reverse slit S2, where the reverse slit is a gap S2 between main electrodes respectively of adjacent lines and is wider than the main electrode gap S1 for generating the surface discharge in each line. Third dielectric layers 55 form a shielding pattern of stripes throughout the entire display area ESc as shown in FIGS. 7A and 7B so as to hide fluorescent material layer existing between the lines, resulting in an enhancement of the display contrast. Moreover, the third dielectric layer covering the metal electrode 42*c* produces a thicker layer than the other portion of the main electrodes Xc & Yc; accordingly the unnecessary discharge to be generated above metal electrode 42*c* is suppressed so as to enhance the luminous efficiency in the same way as described in the fifth preferred embodiment.

In the above-described preferred embodiments the deposited dielectric layer was described to be typically 10 $\mu$m thick, the thickness chosen to be 5 to 30 $\mu$m as long as the other requirement can be satisfied, such as the amount of the warp and the firing voltage of the surface discharge, etc.

According to the fabricating method of the present invention, the dielectric layer 17, 17*b* and 17*c* can be formed at a temperature lower than the case where the dielectric layer is formed by a firing method for which the glass substrate must be fired at a high temperature. Therefore, the heat stress in the glass substrate can be reduced.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

I claim:

1. A fabricating method of a gas discharge display device having a dielectric layer spreading over an entire display area so as to cover electrodes arranged on a substrate, comprising:

arranging the electrodes on the substrate; and forming homogeneously the dielectric layer upon and in conformance with a surface of the substrate, on which the electrodes have been arranged, by the use of a plasma chemical vapor deposition method, wherein the dielectric layer is formed of a layer having a compression stress.

2. A fabricating method of a gas discharge display device having a dielectric layer spreading over an entire display area to cover main electrodes arranged to form an electrode pair for causing a surface discharge, the main electrodes being constituted of a stack of a transparent electrode and a metal electrode thereon on a substrate, said method comprising:

arranging the main electrodes on the substrate; and forming the dielectric layer upon and in conformance with a surface of the substrate on which the main electrodes are arranged, by the use of a plasma chemical vapor deposition method.

3. A fabricating method of a gas discharge display device as recited in claim 2, further comprising:

forming an insulating layer partially covering at least one of the main electrodes before said forming of the dielectric layer.

4. A fabricating method of a gas discharge display device as recited in claim 2, further comprising the step of:

forming a light shielding layer between the electrodes excluding the surface discharge gap within the display area before forming the dielectric layer.

5. A fabricating method of a gas discharge display device as recited in claim 2, wherein the dielectric layer is formed of a layer having a compression stress.

6. A fabricating method of a gas discharge display device as recited in claim 2, wherein the dielectric layer is formed of a silicon compound.

7. A fabricating method of a gas discharge display device as recited in claim 2, wherein the dielectric layer is formed of a layer having a compression stress.

8. A fabricating method of a gas discharge display device as recited in claim 2, wherein thickness of said dielectric layer is 5 to 30 $\mu$m thick.

9. A fabricating method of a gas discharge display device as recited in claim 2, wherein a residual stress of the film is compressive when the film forming process is finished.

10. A fabricating method of a gas discharge display device as recited in claim 1, wherein the dielectric layer is formed of a silicon compound.

11. A fabricating method of a gas discharge display device as recited in claim 1, wherein thickness of said dielectric layer is 5 to 30 $\mu$m thick.

12. A fabricating method of a gas discharge display device as recited in claim 1, wherein a residual stress of the film is compressive when the film forming process is finished.

13. A fabricating method of a gas discharge display device having a dielectric layer spreading over an entire display area so as to cover electrodes arranged on a substrate, comprising:

arranging the electrodes on the substrate; and forming the dielectric layer upon a surface of the substrate, on which the electrodes have been arranged, by the use of a plasma chemical vapor deposition method, wherein the dielectric layer is formed of a layer having a compression stress.

* * * * *